US007728241B2

(12) United States Patent
Ito

(10) Patent No.: US 7,728,241 B2
(45) Date of Patent: Jun. 1, 2010

(54) ELECTRONIC APPARATUS

(75) Inventor: Yoshiyuki Ito, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 0 days.

(21) Appl. No.: 12/138,926

(22) Filed: Jun. 13, 2008

(65) Prior Publication Data

US 2008/0308398 A1 Dec. 18, 2008

(30) Foreign Application Priority Data

Jun. 14, 2007 (JP) ..... 2007-157264

(51) Int. Cl.
*H01H 9/00* (2006.01)

(52) U.S. Cl. ..... 200/331; 200/333

(58) Field of Classification Search ..... 200/43.01, 200/43.04, 43.07, 50.01, 50.02, 50.1, 61.62, 200/330, 331, 329, 333, 334, 341
See application file for complete search history.

(56) References Cited

U.S. PATENT DOCUMENTS

| | | | | |
|---|---|---|---|---|
| 3,182,160 | A * | 5/1965 | Zavertnik et al. | 200/302.2 |
| 3,243,565 | A * | 3/1966 | Sutton | 200/330 |
| 3,924,085 | A * | 12/1975 | Stone | 200/61.62 |
| 3,946,171 | A * | 3/1976 | Kuhfus | 200/5 R |
| 4,011,423 | A * | 3/1977 | Zepp | 200/330 |
| 4,978,817 | A * | 12/1990 | Honda | 200/50.1 |
| 5,193,667 | A * | 3/1993 | Choi | 200/331 |
| 6,846,999 | B2 * | 1/2005 | Kawakami et al. | 200/341 |
| 7,141,750 | B2 * | 11/2006 | Yamada | 200/341 |
| 7,268,306 | B2 * | 9/2007 | Ikunami | 200/11 R |
| 7,408,128 | B2 * | 8/2008 | Watanabe | 200/329 |

FOREIGN PATENT DOCUMENTS

| | | | |
|---|---|---|---|
| JP | 51-38651 | U | 3/1976 |
| JP | 57-114593 | U | 7/1982 |
| JP | 06-10711 | | 2/1994 |
| JP | 02-541561 | | 4/1997 |
| JP | 03-044549 | | 10/1997 |
| JP | 2001-308993 | A | 11/2001 |
| JP | 2004-221011 | A | 8/2004 |
| JP | 2006-035649 | | 2/2006 |
| JP | 2007-005103 | | 1/2007 |

OTHER PUBLICATIONS

JP Office Action dtd May 26, 2009, JP Appln. 2007-157264, partial English translation.
JP Office Action dtd Sep. 10, 2009, JP Appln. 2007-157264, partial English translation.

* cited by examiner

*Primary Examiner*—Michael A Friedhofer
(74) *Attorney, Agent, or Firm*—Banner & Witcoff, Ltd.

(57) ABSTRACT

An electronic apparatus, an imaging apparatus, and a printer are provided. The electronic apparatus includes a main body case; a cover that is provided on the main body case so as to be openable and closable; a button, which is provided on the cover, for making a pressing operation; and a switch that is provided on the main body case, the switch being pressed by receiving a pressing force from the button in a state where the cover is closed.

13 Claims, 8 Drawing Sheets

ELECTRONIC APPARATUS

CROSS REFERENCE TO RELATED APPLICATION

The present application claims priority from Japanese Patent Application No. 2007-157264, which was filed on Jun. 14, 2007, the disclosure of which is herein incorporated by reference in its entirety.

TECHNICAL FIELD

Apparatuses consistent with the present invention relate to an electronic apparatus and, more specifically, to an electronic apparatus with an operation member provided on a cover that is openable and closable.

BACKGROUND

Related art electronic apparatuses have a cover which faces a front of the apparatus (and hence toward a user of the apparatus) and can be opened or closed on the front side of a main body case of the apparatus. The cover is opened to perform a predetermined operation, such as exchanging expendable parts within the apparatus. The electronic apparatuses are also typically provided with a button for performing a predetermined input operation, such as switching on and off the electronic apparatus. For example, in the related art electronic apparatus described in Japanese unexamined patent application publication No. JP-A-2006-35649, a button is provided at a position on the back of the apparatus, i.e., away from the front side facing a user, such as a position on the upper side of the main body case. This results in a disadvantage in that it is difficult to perform an input operation using the button because the user must reach over the electronic apparatus. This disadvantage is made worse depending on the placement of the apparatus. For example, if the electronic apparatus is placed on a bookshelf, a top shelf member limits the ability to reach over the electronic apparatus.

SUMMARY

As a potential solution to this problem, it has been proposed to place the button on the cover of the electronic apparatus. However, if the button is provided on the cover, another disadvantage results in that both the button and the electric switch that outputs an ON signal by receiving a pressing force from the button must also be provided on the cover. Therefore, it is required to wire the switch and a control circuit disposed in the main body case through an electric cable attached to the cover. This, then, prevents a disadvantage in that there is a risk that the electric cable may become damaged or disconnected because the electric cable is bent when the cover is opened or closed.

It is an aspect of the present invention to provide an electronic apparatus that can provide a button that is easy to actuate. It is another aspect of the present invention to provide an electronic apparatus that can dispense with the wiring between the cover and the main body case of the electronic apparatus.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an illustrative aspect of the present invention, there is provided an electronic apparatus comprising a main body case; a cover that is provided on the main body case so as to be openable and closable; a button, which is provided on the cover, for making a pressing operation; and a switch that is provided on the main body case, the switch being pressed by receiving a pressing force from the button in a state where the cover is closed.

According to another illustrative aspect of the present invention, there is provided an imaging apparatus comprising a main body case; a front cover which is disposed to cover a portion of the side and a portion of an upper surface of the main body case, the front cover being pivotable about an axis; a button, which is provided on a portion of the front cover that covers the upper surface of the main body and comprises at least two pressing portions; and an electrical switch that is provided on the main body case and comprises a push switch and a push member, wherein, when a pressing force is applied to the pressing portions, the pressing portions contact the push member and actuate the push switch.

According to another illustrative aspect of the present invention, there is provided a printer comprising a main body case comprising a sheet discharge tray located on an upper surface thereof, a feeding unit, an image forming unit, a fixing unit; a front cover which is disposed to cover a portion of the side and a portion of the upper surface of the main body case, the front cover being pivotable about an axis; a button, which is provided on a portion of the front cover that covers the upper surface of the main body and comprises at least two pressing portions; and an electrical switch that is provided on the main body case and comprises a push switch and a push member, wherein, when a pressing force is applied to the button, at least one of the pressing portions contacts the push member and actuates the push switch.

BRIEF DESCRIPTION OF THE DRAWINGS

Illustrative aspects of the present invention will be described in detail with reference to the following figures wherein.

DETAILED DESCRIPTION OF EXEMPLARY EMBODIMENTS OF THE PRESENT INVENTION

An exemplary embodiment of the present invention will be described below with reference to FIGS. 1 to 8.

(Overall Constitution)

Figure 1:
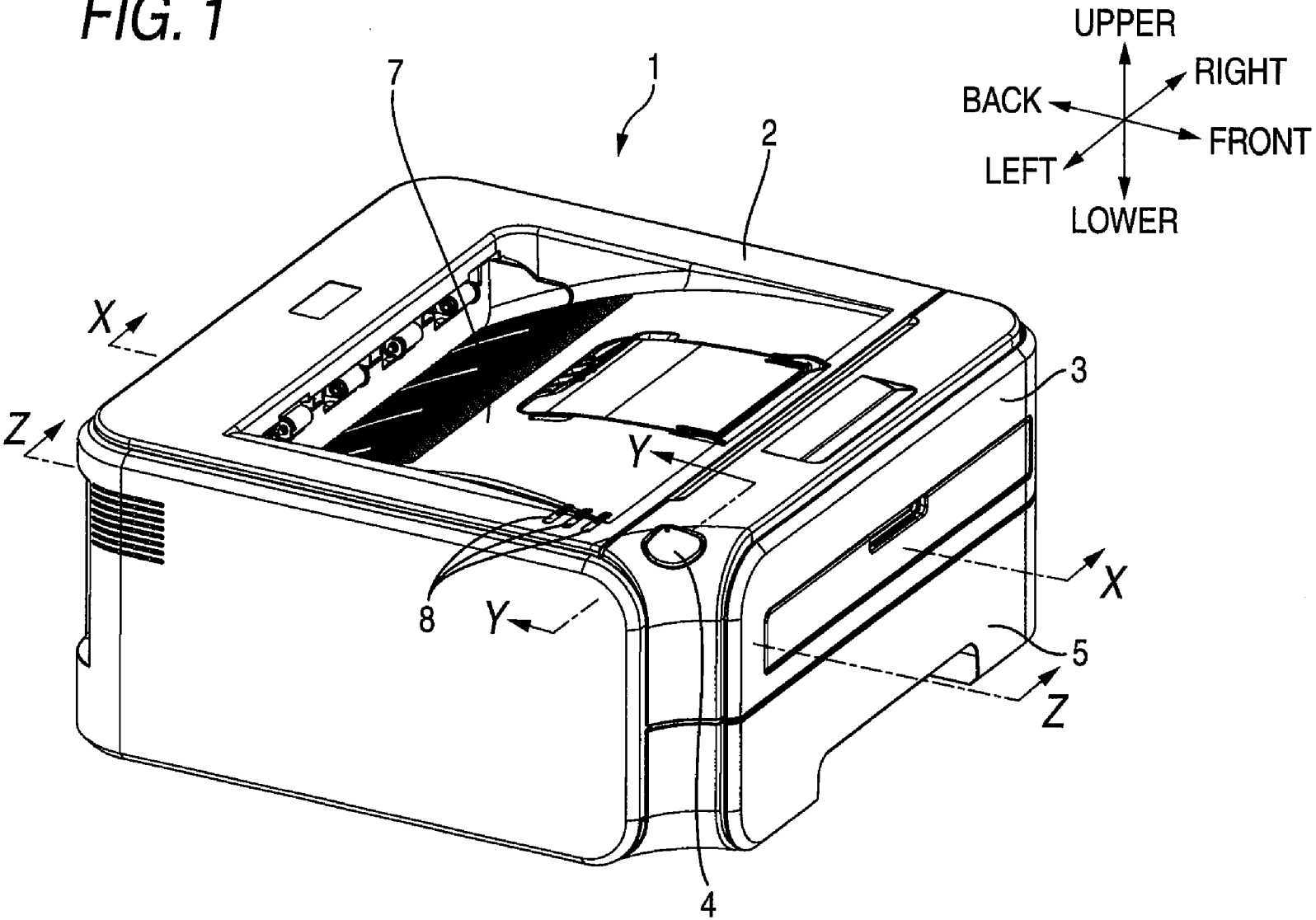
FIG. 1 is a perspective view showing an electronic apparatus according to an exemplary embodiment of the present invention.

FIG. 1 is a perspective view showing an electronic apparatus according to an exemplary embodiment of the present invention. In this exemplary embodiment, the electronic apparatus is embodied in the form of a printer 1. The printer 1 has a main body case 2 in the shape of a box as a whole. The main body case 2 has a face referred to as a "front face of the printer 1". A front cover 3 is disposed on the front face of the printer 1 so as to be openable and closable. The front cover 3 (one example of the cover) is opened to exchange a process cartridge 17 and perform a jamming process for the paper 6. The front cover 3 has a shape covering the upper half of the front face and the front end side of the upper surface of the printer 1. In other words, the front cover 3 covers an upper half of a side of the printer 1 and wraps around from the side over the top of the printer 1.

A button 4 is provided at the left end on the upper surface of the front cover 3. The button 4 is pressed to perform an operation on the printer 1. For example, the button 4 may be pressed to switch between an online state where printing is enabled and an offline state where the printing is stopped, or to issue a print command for a test pattern. A sheet feed tray 5 that can be pulled out is provided under the front cover 3.

Also, a sheet discharging tray 7 on which printed paper 6 is stacked is provided on the upper surface of the main body case 2. One or more lamps 8 that emit light in a pattern according to a state of the printer 1 (e.g., a state of a remaining amount of toner, life of a drum, paper jam, or a presence or absence of a sheet feeder unit) is provided near the operation button 4 on the upper surface of the main body case 2.

Figure 2:
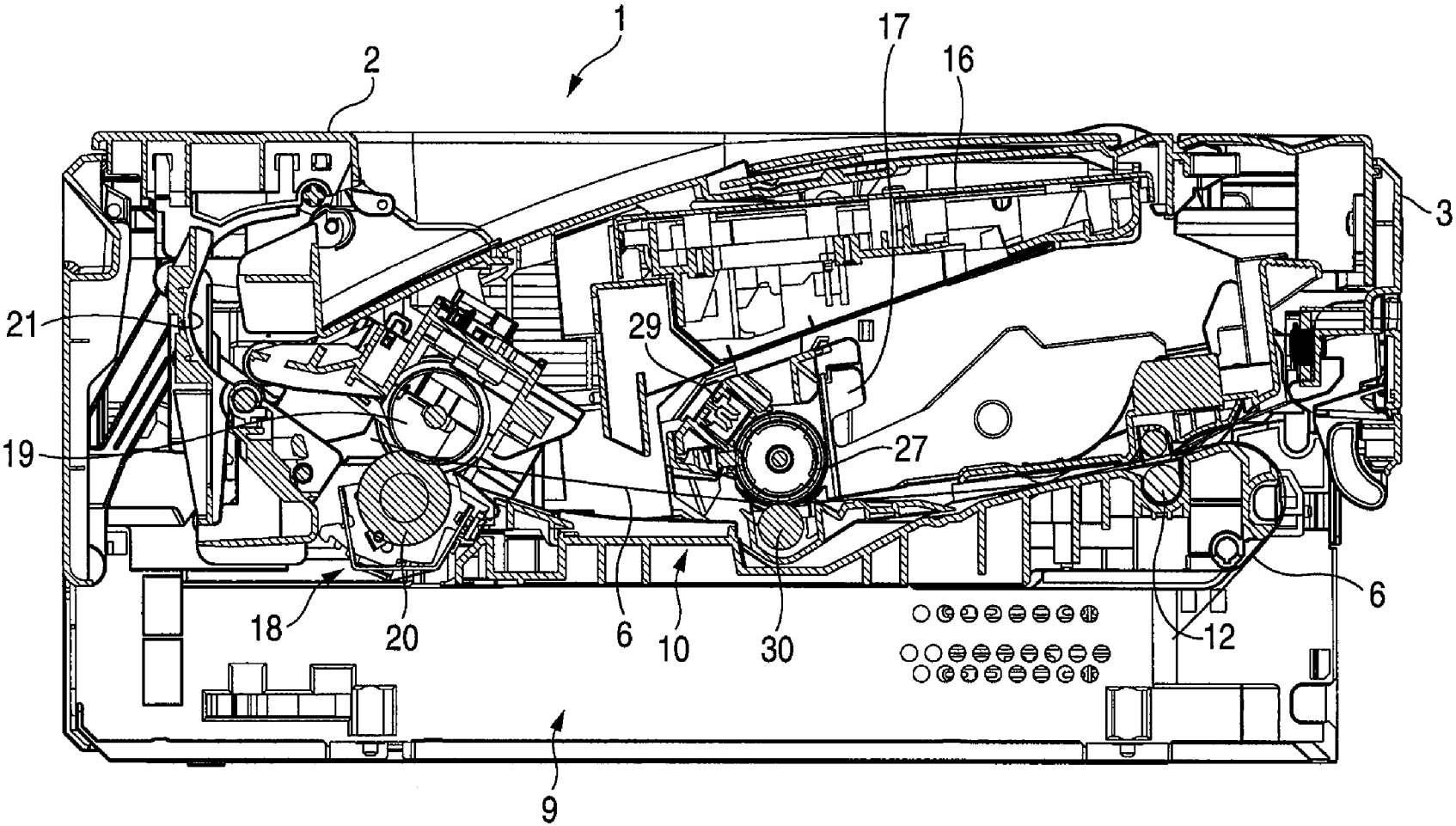
FIG. 2 is a cross-sectional view of the electronic apparatus of FIG. 1 taken along the line X-X.

FIG. 2 is a side cross-sectional view of the electronic apparatus of FIG. 1. The right side of FIG. 2 corresponds to the front side of the printer 1 in FIG. 1. FIG. 2 shows the printer 1 in a state where the sheet feed tray 5 is pulled out. A sheet of paper 6 is provided as the printing medium, and the printer 1 comprises a feeder unit 9 for feeding the paper 6 and an image forming unit 10 for forming the image on the fed paper 6 in the main body case 2.

(1) Feeder Unit

The feeder unit 9 comprises the sheet feed tray 5, a sheet feed roller (not shown) and a registration roller 12. The paper 6 on the top of the sheet feed tray 5 is fed one by one by the feed roller. The fed paper 6 is registered by the registration roller 12 and fed to a transfer position.

(2) Image Forming Unit The image forming unit 10 comprises a scanner unit 16, a process cartridge 17 and a fixing unit 18.

The scanner unit 16 has a laser emitting part and a polygon mirror (not shown). A laser beam emitted from the laser emitting part is deflected by the polygon mirror, and applied onto the surface of a photosensitive drum 27.

Also, the process cartridge 17 has a developing roller (not shown), the photo sensitive drum 27, a scorotron type charger unit 29 and a transfer roller 30.

The charger unit 29 positively charges the surface of the photosensitive drum 27 uniformly. Thereafter, the surface of the photosensitive drum 27 is exposed by the laser beam from the scanner unit 16 so that an electrostatic latent image is formed thereon. Then, the toner carried on the surface of the developing roller is supplied to the electrostatic latent image formed on the photosensitive drum 27, so that the electrostatic latent image is developed.

When the paper 6 passes through the transfer position, a transfer voltage is applied to the transfer roller 30, so that a toner image on the photosensitive drum 27 is transferred onto the paper 6.

The fixing unit 18 thermally fixes the toner on the paper 6 while the paper 6 passes between a heating roller 19 and a pressing roller 20. The paper 6 after thermal fixing is exhausted via a sheet discharging path 21 onto a sheet output tray 7.

(Constitution of Button and Switch)

Figure 3:
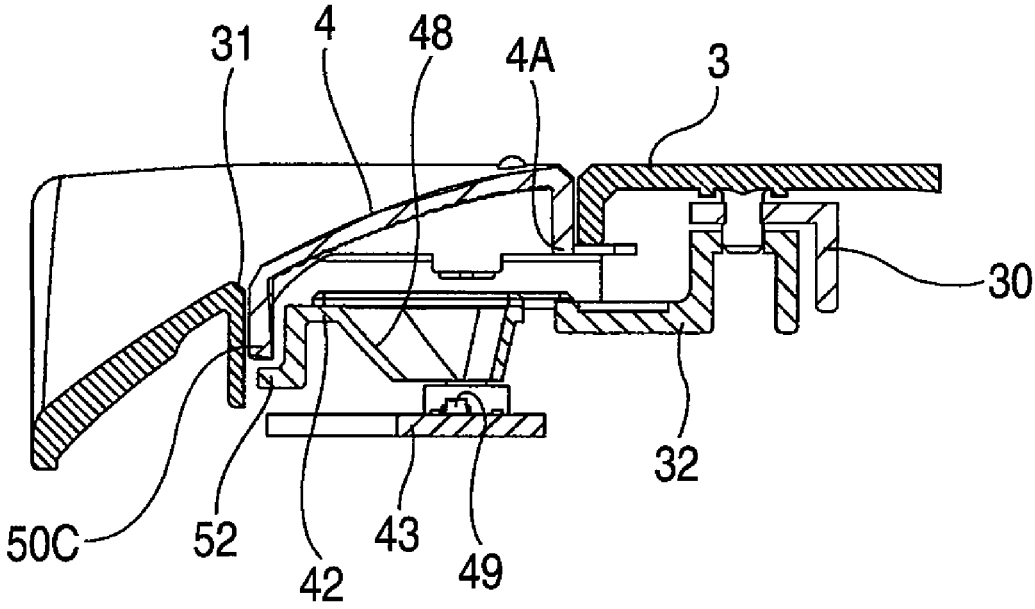
FIG. 3 is a cross-sectional view of the electronic apparatus of FIG. 1 taken along the line Y-Y.

The button 4 is provided on the front cover 3, and not on the main body case 2. FIG. 3 is a cross-sectional view of a peripheral portion around the button 4 and the switch 40 along the line Y-Y of FIG. 1. A through hole 31 is formed in an inclined portion at the left end of the front cover 3, and the button 4 is inserted therein, as shown in FIG. 3. The button 4 is made of a light permeable resin material, in which a base end portion 30 thereof is held on the back side of the front cover 3, and the base end portion 30 and one end 4A of the button 4 are integrally coupled via a thin-walled resin spring (not shown). Thereby, the button 4 is movable substantially vertically within the through hole 31 of the front cover 3 when the resin spring is deformed (flexed) against its own elasticity.

Also, a stopper member 32 (one example of block unit) is fixed on the back side of the front cover 3, in which the top end of the stopper member 32 is disposed with a gap under the one end 4A of the button 4.

Figure 4:
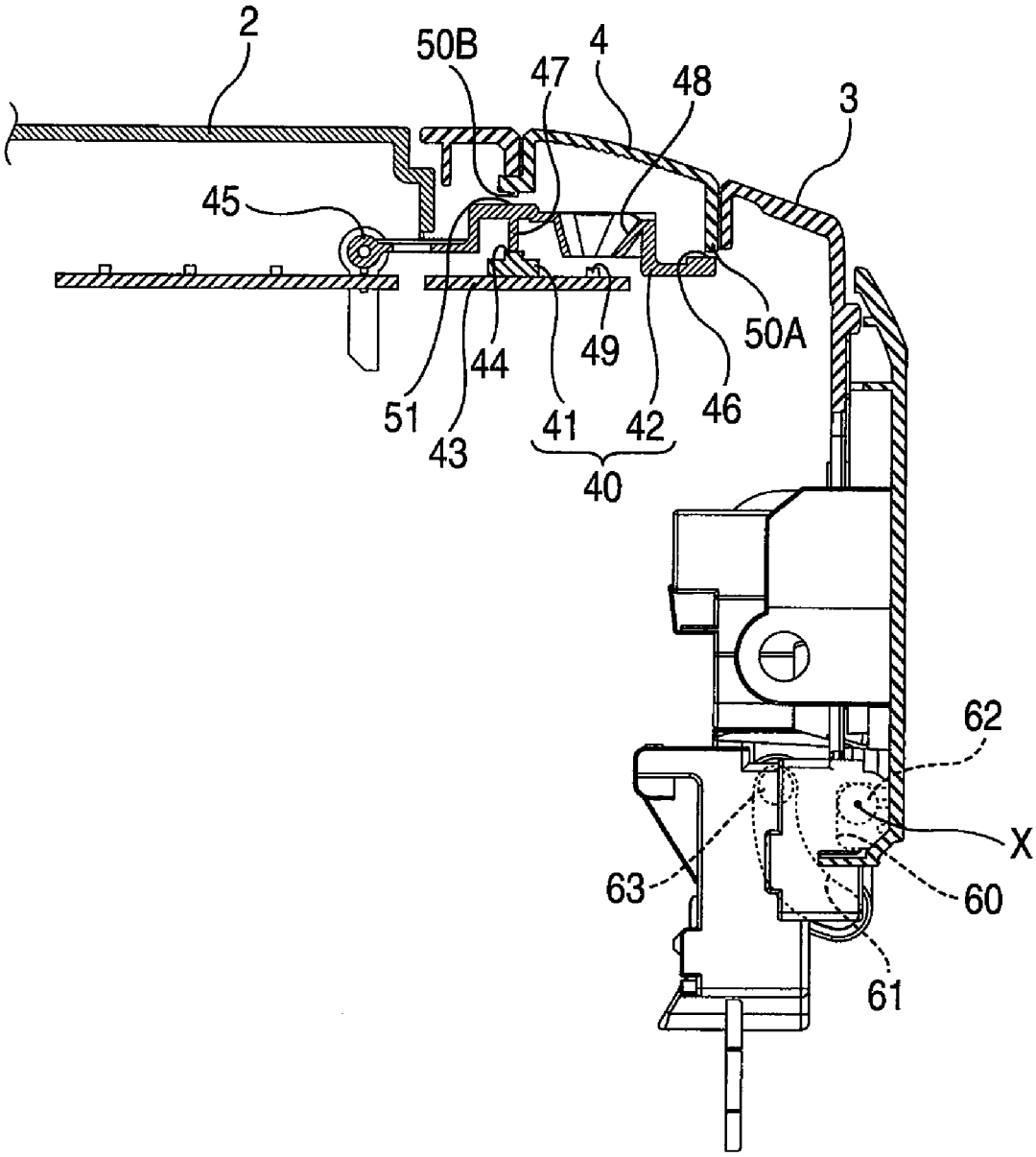
FIG. 4 is a cross-sectional view of the electronic apparatus of FIG. 1 taken along the line Z-Z in a state in which a cover is closed.

FIG. 4 is a cross-sectional view of the peripheral portion around the button 4 and the switch 40 along the line Z-Z of FIG. 1. The switch 40 has a tactile feedback push switch (hereinafter simply referred to as a "push switch 41") and a push member 42. The push switch 41 is a non-lock type switch that is not locked even by pressing the top key 44, and returns at the same time when released. The push switch 41 is mounted on a circuit board 43. If the top key 44 is pressed, the push switch 41 outputs a signal to a control circuit (not shown) of the printer 1 coupled to the circuit board 43.

The push member 42 has a rear base end portion 45 axially supported rotatably, so that a top end portion 46 is vertically swingable. Also, a boss 47 that contacts with the top key 44 is provided in a substantially central portion of the push member 42. A hole 48 opening upward widely is formed just under the button 4 between the boss 47 and the top end portion 46. A light emitting device 49 (one example of a light emitting part, for instance, a light emitting diode) is mounted just under the hole 48 and on the circuit board 43. A light emitted from the light emitting device 49 is applied through the hole 48 of the push member 42 to the rear surface of the button 4, so that the button 4 emits light.

If a pressing operation is performed on the button 4, the push member 42 pushes the top key 44 of the push switch 41 by receiving a pressing force from the button 4. Herein, in this exemplary embodiment, three pressing portions 50A, 50B and 50C are provided on the button 4. Specifically, a pressing portion 50A is located at the front end of the button 4 to press the top end portion 46 (one example of the contact portion) of the push member 42. A pressing portion 50B is located at the back end of the button 4 to press a central portion 51 (one example of the contact portion) of the push member 42. Further, in this exemplary embodiment, a protruding portion 52 protruding sideways of the push member 42 is provided, as shown in FIG. 3. Also as shown in FIG. 3, a pressing portion 50C at the side end of the button 4 presses the protruding portion 52 (one example of the contact portion).

(Opening and Closing Structure)

The front cover 3 is opened or closed by pivoting around the lower end thereof. A first groove 60 and a second groove 61 are provided at both ends on the lower side of the front cover 3 (only one end is shown), as shown in FIG. 4. The first groove 60 has a vertically extending shape. The second groove 61 has a shape extending like a circular arc from behind the first groove 60 downward. Guide pins 62 and 63, which are located at the upper end of the first groove 60 and the second groove 61 when the front cover 3 is closed, are provided on the main body case 2. The first groove 60 and the second groove 61 and the guide pins 62 and 63 are placed more to the front side of the printer 1 than the pressing portions 50A, 50B and 50C and the push member 42 of the button 4. In other words, the first groove 60 and the second groove 61 and the guide pins 62 and 63 are located further to the right in FIG. 4 than the pressing portions 50A, 50B, and 50C and the push member 42.

Also, the second groove 61 changes to be more separated away from the guide pin 62 toward the lower side, not at a constant curvature around the guide pin 62 located within the first groove 60, in a state where the front cover 3 is closed, as shown in FIG. 4. Thereby, when the front cover 3 is opened, the guide pin 62 is subjected to a force tending to be relatively moved downward within the first groove 60, as the guide pin 63 is relatively moved within the second groove 61. A portion at the open end of the front cover 3, namely, an upper portion where the button 4 is provided, is moved in a direction separated away from the guide pin 62, as seen from the main body case 2 (see FIGS. 6 and 7).

On the other hand, when the front cover 3 is closed, the portion at the open end of the front cover 3, namely, the upper portion where the button 4 is provided, is gradually permitted to move in a direction approaching the guide pin 62. As a result, the upper portion where the button 4 is provided is closed owing to deadweight of the front cover 3 itself, while moving in the direction towards the guide pin 62.

Figure 5:
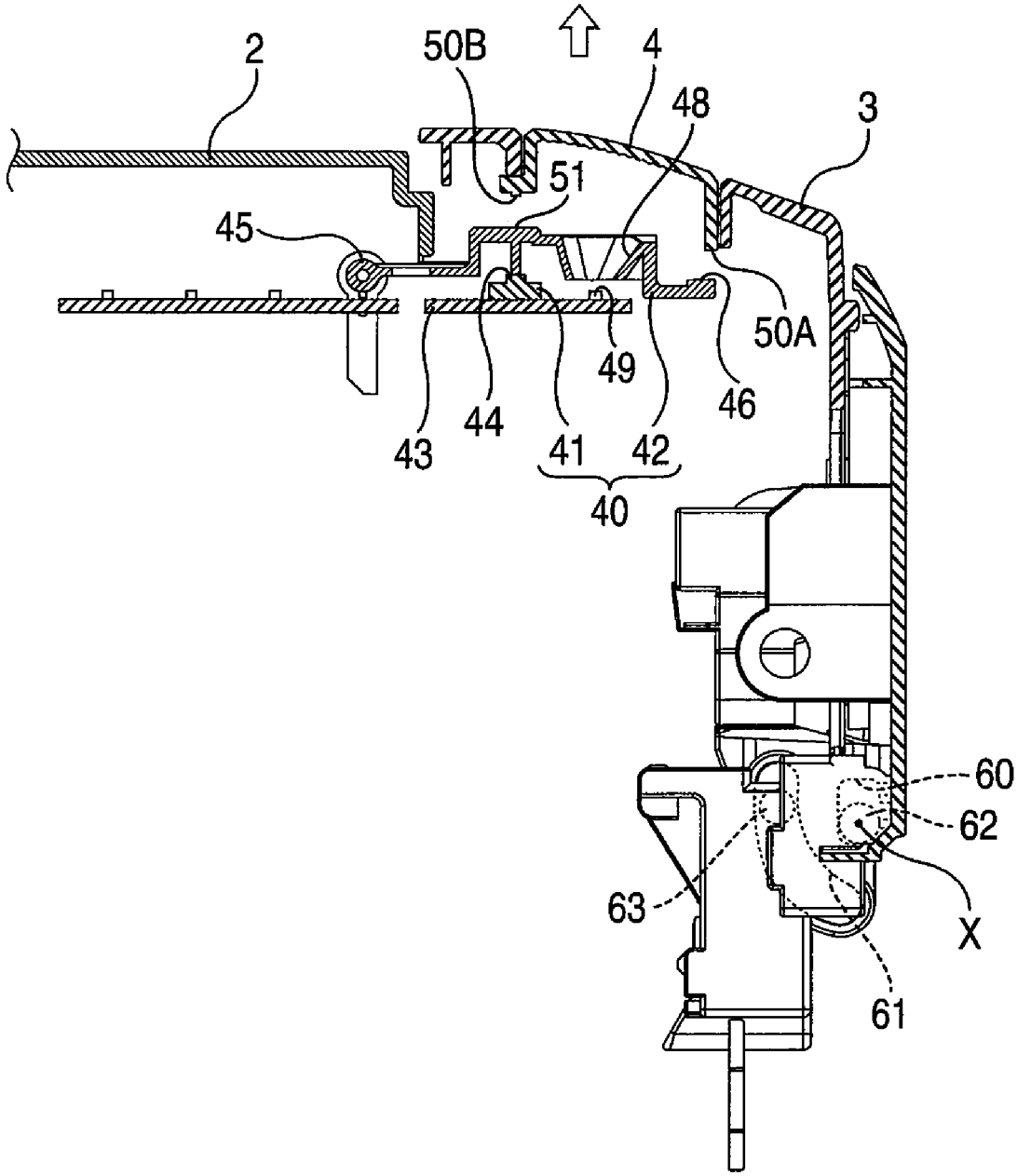
FIG. 5 is a cross-sectional view of the electronic apparatus of FIG. 1 taken along the line Z-Z in a state in which the cover is opened.
Figure 6:
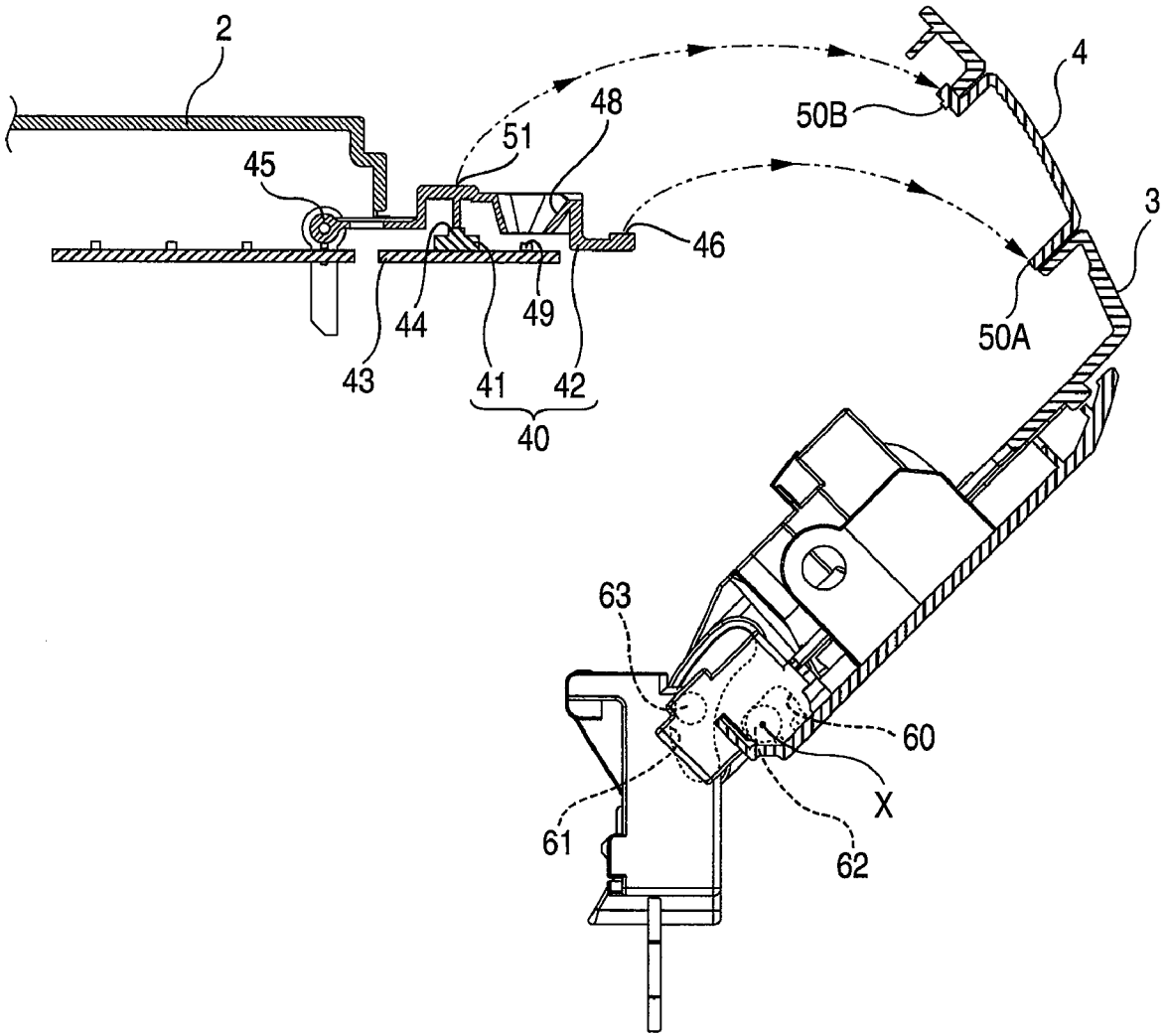
FIG. 6 is a cross-sectional view of the electronic apparatus of FIG. 1 taken along the line Z-Z in a state in which the cover is halfway opened.
Figure 7:
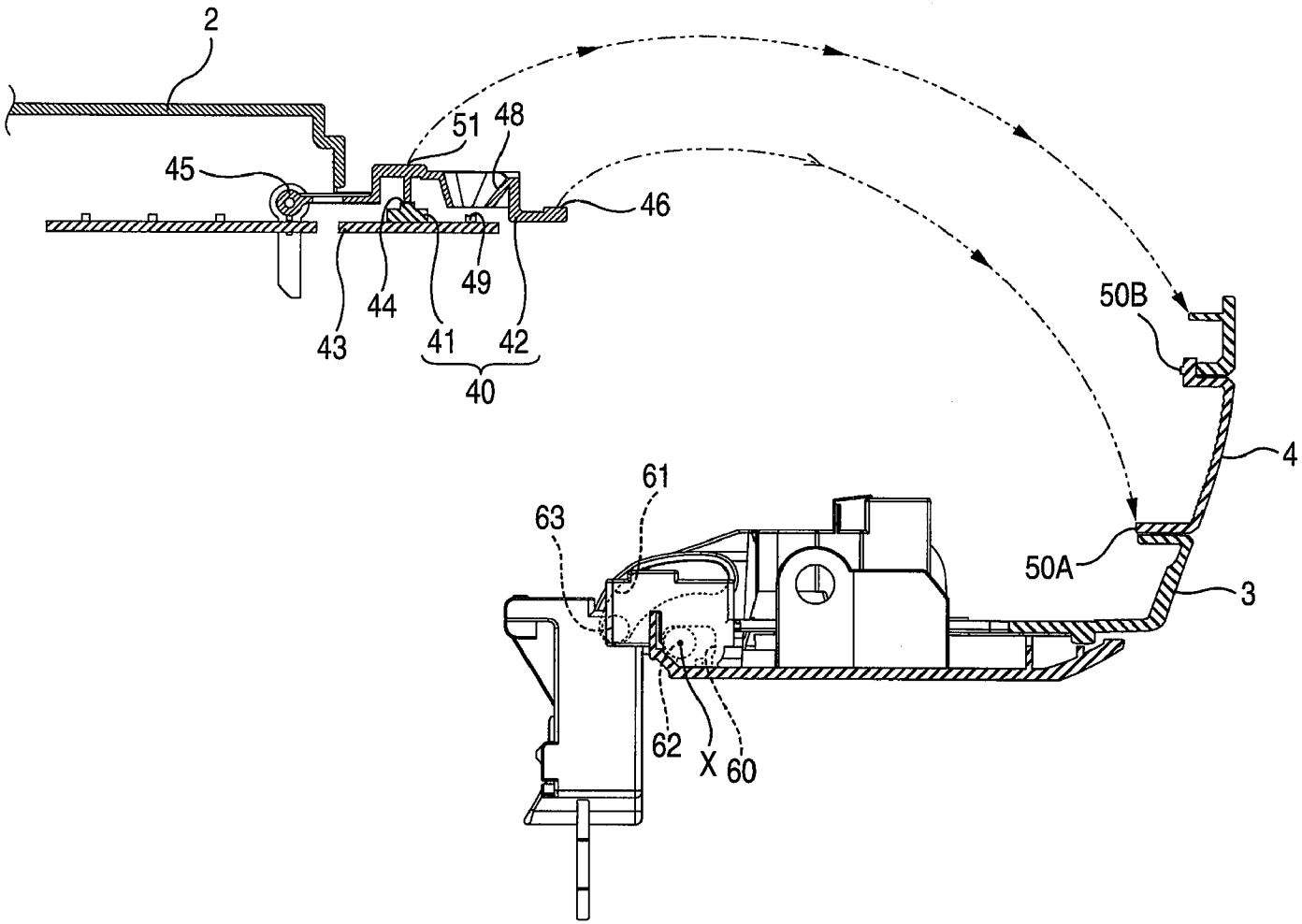
FIG. 7 is a cross-sectional view of the electronic apparatus of FIG. 1 taken along the line Z-Z in a state in which the cover is opened.
Figure 8:
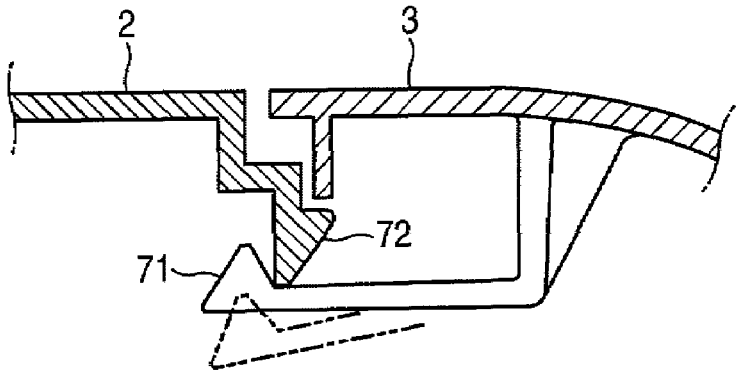
FIG. 8 is a view showing a latch mechanism according to an exemplary embodiment of the present invention.

When the front cover 3 is kept, only with deadweight, in a state where the front cover 3 is closed, if there is a force tending to raise the front cover 3 against the deadweight, for example, the front cover is simply raised, as shown in FIG. 5. In order to prevent this motion, it is possible to use a latch mechanism for keeping the front cover 3 in the closed state, as shown in FIG. 8. That is, as shown in FIG. 8, a latch piece 71 flexible against its own elasticity is provided integrally with the front cover 3, while an engagement part 72 is provided at a position capable of being engaged by the latch piece 71 on the main body case 2. Thereby, the latch piece 71 engages the engagement part 72 from an underside owing to an elastic force of the latch piece 71 itself in a state where the front cover 3 is closed, so that the front cover 3 is subjected to a downward biasing force to prevent the front cover 3 from being abruptly raised.

In opening the front cover 3, the front cover 3 is opened against an elastic force of the latch piece 71. That is, since the inclined face of the latch piece 71 contacts the engagement part 72, and simply gets over the lower side of the engagement part 72, in this exemplary embodiment it is unnecessary to make any special button operation with a lock release button or the like.

Of course, as an alternative, the front cover 3 may be held in the closed state by a lock mechanism having a lock release button.

When the front cover 3 is opened, the pressing portions 50A, 50B and 50C of the button 4 are moved in a direction away from the position near the guide pin 62 in the central axis of opening or closing the front cover. On the other hand, when the front cover 3 is closed, the pressing portions 50A, 50B and 50C of the operation button 4 are moved in a direction approaching the guide pin 62. Accordingly, the first groove 60 and the second groove 61 and the guide pins 62 and 63 function as a movement unit.

Effects of the Exemplary Embodiment (1) The printer 1 is provided with the front cover 3 and the sheet feed tray 5 on the front side of the printer 1. Accordingly, the button 4 is provided on the front side in consideration of the operability of the user. Thus, the button 4 is provided on the front cover 3 in terms of the design in this exemplary embodiment. And the button 4 is provided on the front cover 3, and the switch 40 that is turned on or off owing to a pressing force from the button 4 is provided on the main body case 2, where by no electrical configuration is provided on the front cover 3. Thereby, the wiring between the front cover 3 and the main body case 2 can be dispensed with.

Figure 9:
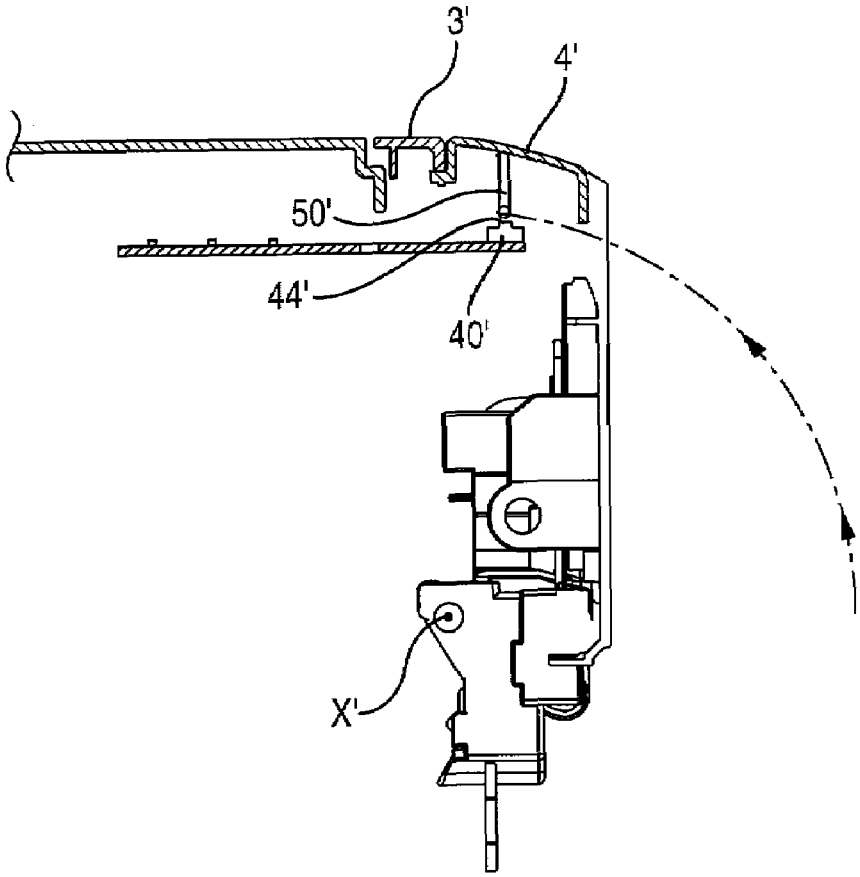
FIG. 9 is a cross-sectional view of a button and switch according to a comparative example.

(2) Referring to FIG. 9, if the pressing portion 50' of the button 4' is placed more to the front side of the printer 1 than the central axis X' in the opening or closing operation of the front cover 3' as in a comparative example as shown in FIG. 9, the pressing portion 50' of the button 4' strikes sideways against the contact portion (i.e., the top key 44' of the push switch) of the switch 40', and can possibly damage both the pressing portion 50' and the switch 40' when the front cover 3' is closed. As a countermeasure, it is possible to widen a gap between the pressing portion 50' of the button 4' and the contact portion of the switch 40' in a state where the front cover 3' is closed. However, if the gap is widened, the button 4' must be pressed into deeper position as the gap is wider, so that the switch 40' can not be turned on, which decreases the operability. Further, there are disadvantages that it is difficult to downsize the apparatus and to design the apparatus.

By contrast to the comparative example shown in FIG. 9, in the present exemplary embodiment the first groove 60 and the second groove 61 and the guide pins 62 and 63 are placed more to the front side of the printer 1 than the pressing portions 50A, 50B and 50C and the push member 42 of the button 4. That is, the central axis X around which the front cover 3 is opened or closed is arranged in front of the contact portions 46, 51 and 52 of the switch 40, as seen from the front side of the printer 1. Thereby, when the front cover 3 is closed, the pressing portions 50A, 50B and 50C of the button 4 approach the contact portions 46, 51 and 52 of the switch 40 from above, suppressing interference between the pressing portions 50A, 50B and 50C and the contact portions 46, 51 and 52.

Along with the opening or closing operation of the front cover 3, the pressing portions 50A, 50AB and 50C of the button 4 are moved in a direction away from the position near the guide pins 62 in the central axis of opening or closing the front cover, when the front cover 3 is opened. Also, when the front cover 3 is closed, the pressing portions 50A, 50B and 50C of the button 4 are moved in the direction approaching the guide pin 62. Accordingly, it is possible to suppress more securely interference between the pressing portions 50A, 50B and 50C and the contact portions 46, 51 and 52 in opening or closing the front cover 3. Also, even in the case where a lower end face of the front cover 3 and a portion of the main body opposed on the lower side thereof, for example, an upper end face on the front side of the sheet feed tray 5, are disposed proximately, in a state where the front cover 3 is closed, as shown in FIG. 1, there is no risk that both may contact in opening or closing the front cover 3. In other words, since it is not required to provide a large gap to avoid contact, there is no danger that foreign objects may be pinched by mistake or that dust may enter.

(3) In the present exemplary embodiment, a light emitting device 49 is disposed on the rear side to make the button 4 itself luminous. Accordingly, the pressing portion for pressing the push member 42 is not provided at the central position of the button 4. Instead, the button 4, which is disposed on the inclined portion of the front cover 3, may be pressed from various angles, since the push member 42 is pressed by plural pressing portions (50A, 50B, 50C) located on the periphery of the button 4. Accordingly, even when the button 4 is pressed from various angles, the push member 42 can be pressed to securely push the top key 44 of the push switch 41.

(4) Although the button 4 may be pressed in a state where the front cover 3 is opened, one end 4A thereof contacts the stopper member 32 to prevent the button from being further pressed down when the button 4 is pressed beyond a range. Accordingly, since the range where the button 4 is pressed can be limited, the button is prevented from being pressed too far and thus broken.

Other Exemplary Embodiments

The present inventive concept is not limited to the above-described embodiments.

(1) For example, the electronic apparatus may include an image processing apparatus (e.g., an image forming apparatus or an image reading apparatus such as an ink jet printer or a facsimile apparatus), other than the laser printer 1 as described above. In fact, the present inventive concept is applicable to any electronic apparatus that includes a front cover and a button for operating the electronic apparatus. In other words, the electronic apparatus may also include an apparatus having the cover that can be opened or closed to perform an operation such as an exchange of expendables within the apparatus.

(2) As another example, although the button 4 presses the switch 40 (push member 42) at three points, the button may press the switch at a different number of points, such as at two points across the light emitting device 49, or at four or more points.

(3) As another example, although the switch 40 having the push member 42 in addition to the push switch 41 is exemplified as the "switch", the pressing portion of the button 4 without the push member 42 may directly press the push switch 41.

According to exemplary embodiments of the present invention, electrical parts for implementing the button are not used on the cover since the button is provided on the cover and the switch which is pressed by directly and indirectly receiving the pressing force from the button is provided on the main body case. Therefore, wiring is not used between the cover and the main body case.

According to the exemplary embodiments of the present invention, the button is provided on the cover, and the switch pressed by receiving the pressing force from the operation button is provided on the main body cover, whereby no electrical configuration for the button operation is provided on the cover. Thereby, the wiring between the cover and the main body case can be dispensed with.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An electronic apparatus comprising:

a main body case;

a cover that is provided on the main body case so as to be openable and closable;

a button, which is provided on the cover, for making a pressing operation; and a switch that is provided on the main body case, the switch being pressed by receiving a pressing force from the button in a state in which the cover is closed, wherein the cover is opened and closed by rotating around a central axis for opening and closing the cover, and wherein the button comprises a pressing portion which presses the switch with the pressing force, and the switch comprises a contact portion which is pressed by the pressing portion, and the pressing portion is located on an outside of the contact portion as seen from the central axis in a state in which the cover is closed, and the contact portion is located in a farther position than the central axis in a cover closing direction as seen from a face provided with the cover of the main body case.

2. The electronic apparatus according to claim 1, wherein the cover is movable between a first position where the pressing portion is positioned near the central axis and a second position where the pressing portion is separated from the central axis, and the electronic apparatus further comprises a movement unit which moves the cover from the second position to the first position when the cover is turned from an open state to a closed state.

3. The electronic apparatus according to claim 1, wherein a light emitting unit is provided in a portion of the main body case located underneath the button in a state in which the cover is closed, and the pressing portion of the button and the contact portion of the switch contact each other at two points across the light emitting unit.

4. The electronic apparatus according to claim 1, wherein the cover is provided with a block unit which prevents the button from being pressed beyond a certain range in a state in which the cover is opened.

5. The electronic apparatus according to claim 1, wherein the cover is opened and closed by rotating around a central axis for opening and closing the cover, and wherein the button comprises a pressing portion which presses the switch with the pressing force, the switch comprises a contact portion which is pressed by the pressing portion, and, the contact portion is located on an outside of an area through which the pressing portion passes during an opening and closing operation of the cover in a state in which the button is not pushed.

6. An imaging apparatus comprising:

a main body case;

a front cover which is disposed to cover a portion of the side and a portion of an upper surface of the main body case, the front cover being pivotable about an axis;

a button, which is provided on a portion of the front cover that covers the upper surface of the main body and comprises at least two pressing portions; and an electrical switch that is provided on the main body case and comprises a push switch and a push member, wherein, when a pressing force is applied to the pressing portions, the pressing portions contact the push member and actuate the push switch.

7. The imaging apparatus according to claim 6, wherein the electric switch further comprises a circuit board and a light emitting element, the light emitting element and the push switch being disposed on the circuit board, and wherein the push member comprises a hole located in a position corresponding to the light emitting element.

8. A printer comprising:

a main body case comprising a sheet discharge tray located on an upper surface thereof, a feeding unit, an image forming unit, and a fixing unit;

a front cover which is disposed to cover a portion of the side and a portion of the upper surface of the main body case, the front cover being pivotable about an axis;

a button, which is provided on a portion of the front cover that covers the upper surface of the main body and comprises at least two pressing portions; and an electrical switch that is provided on the main body case and comprises a push switch and a push member, wherein, when a pressing force is applied to the button, at least one of the pressing portions contacts the push member and actuates the push switch.

9. An electronic apparatus comprising:

a main body case;

a cover that is provided on the main body case so as to be openable and closable;

a button, which is provided on the cover, for making a pressing operation; and a switch that is provided on the main body case, the switch being pressed by receiving a pressing force from the button in a state in which the cover is closed, wherein a light emitting unit is provided in a portion of the main body case located underneath the button in a state in which the cover is closed, and the pressing portion of the button and the contact portion of the switch contact each other at two points across the light emitting unit.

10. The electronic apparatus according to claim 9, wherein the cover is opened and closed by rotating around a central axis for opening and closing the cover, and wherein the button comprises a pressing portion which presses the switch with the pressing force, and the switch comprises a contact portion which is pressed by the pressing portion, and the pressing portion is located on an outside of the contact portion as seen from the central axis in a state in which the cover is closed, and the contact portion is located in a farther position than the central axis in a cover closing direction as seen from a face provided with the cover of the main body case.

11. The electronic apparatus according to claim 10, wherein the cover is movable between a first position where the pressing portion is positioned near the central axis and a second position where the pressing portion is separated from the central axis, and the electronic apparatus further comprises a movement unit which moves the cover from the second position to the first position when the cover is turned from an open state to a closed state.

12. The electronic apparatus according to claim 9, wherein the cover is provided with a block unit which prevents the button from being pressed beyond a certain range in a state in which the cover is opened.

13. The electronic apparatus according to claim 9, wherein the cover is opened and closed by rotating around a central axis for opening and closing the cover, and wherein the button comprises a pressing portion which presses the switch with the pressing force, the switch comprises a contact portion which is pressed by the pressing portion, and, the contact portion is located on an outside of an area through which the pressing portion passes during an opening and closing operation of the cover in a state in which the button is not pushed.

* * * * *